US010808595B2

(12) United States Patent
Yoon et al.

(10) Patent No.: US 10,808,595 B2
(45) Date of Patent: Oct. 20, 2020

(54) ENGINE COOLING SYSTEM FOR VEHICLE

(71) Applicants: Hyundai Motor Company, Seoul (KR); Kia Motors Corporation, Seoul (KR)

(72) Inventors: Seok Jun Yoon, Anyang-si (KR); HyunWook Ryu, Hwaseong-si (KR); Kyoung Ik Jang, Yongin-si (KR); Wonhyuk Koh, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 288 days.

(21) Appl. No.: 16/100,543

(22) Filed: Aug. 10, 2018

(65) Prior Publication Data

US 2019/0186333 A1 Jun. 20, 2019

(30) Foreign Application Priority Data

Dec. 18, 2017 (KR) ..... 10-2017-0173874

(51) Int. Cl.
*F01P 3/14* (2006.01)
*F01P 11/02* (2006.01)
(Continued)

(52) U.S. Cl.
CPC ..... *F01P 3/14* (2013.01); *F01P 3/02* (2013.01); *F01P 11/0204* (2013.01); *F02F 1/14* (2013.01);
(Continued)

(58) Field of Classification Search
CPC ..... F01P 11/0204; F01P 2003/028; F01P 2007/146; F01P 3/02; F01P 3/14; F02F 1/14; F02F 1/166
See application file for complete search history.

(56) References Cited

U.S. PATENT DOCUMENTS 5,188,071 A * 2/1993 Han ..... F02F 1/108 123/195 R
6,481,392 B1 11/2002 Etemad
(Continued)

FOREIGN PATENT DOCUMENTS

DE 10 2015 120 836 A1 12/2016
EP 2 495 412 A1 9/2012
(Continued)

OTHER PUBLICATIONS

European Search Report dated Nov. 9, 2018 for European Patent Application No. 18194230.1.

*Primary Examiner* — Lindsay M Low
*Assistant Examiner* — Ruben Picon-Feliciano
(74) *Attorney, Agent, or Firm* — Morgan, Lewis & Bockius LLP

(57) ABSTRACT

An engine cooling system for a vehicle may relate for flowing the coolant from the front side to the rear side based on an arrangement direction of the cylinder and simultaneously cooling the coolant by a cross flow type to flow from an exhaust side to an intake side between each combustion chambers while separating and cooling the coolant flowing through the cylinder block and the cylinder head, maximizing an entire cooling efficiency through a flow control of the coolant and reducing a fuel consumption.

17 Claims, 7 Drawing Sheets

(51) Int. Cl.

| | |
|---|---|
| ***F01P 3/02*** | (2006.01) |
| ***F02F 1/16*** | (2006.01) |
| ***F02F 1/14*** | (2006.01) |
| ***F01P 7/14*** | (2006.01) |

(52) U.S. Cl.
CPC ..... *F02F 1/166* (2013.01); *F01P 2003/028* (2013.01); *F01P 2007/146* (2013.01)

(56) References Cited

U.S. PATENT DOCUMENTS

| | | | | |
|---|---|---|---|---|
| 9,790,838 | B2 | 10/2017 | Yoon et al. | |
| 10,190,529 | B1 * | 1/2019 | Nickols | F02F 1/166 |
| 2005/0235930 | A1 * | 10/2005 | Xin | F02F 1/108 123/41.74 |
| 2012/0132157 | A1 * | 5/2012 | Matsuki | F02F 1/14 123/41.79 |
| 2012/0204821 | A1 * | 8/2012 | Tofukuji | F02F 1/14 123/41.79 |
| 2016/0377023 | A1 * | 12/2016 | Suh | F02F 1/14 123/41.79 |
| 2017/0175611 | A1 * | 6/2017 | Wakamoto | F02B 75/20 |
| 2017/0350306 | A1 * | 12/2017 | Makino | F02F 1/14 |
| 2018/0009145 | A1 * | 1/2018 | Fujita | B29C 45/40 |
| 2018/0328277 | A1 * | 11/2018 | Yoshimura | F02B 77/11 |
| 2018/0355780 | A1 * | 12/2018 | Fujita | F01P 3/02 |
| 2018/0363587 | A1 * | 12/2018 | Yoshimura | F01P 3/02 |
| 2019/0032595 | A1 * | 1/2019 | Yoshimura | F02F 1/10 |
| 2019/0360427 | A1 * | 11/2019 | Fujita | F02F 1/004 |
| 2019/0383229 | A1 * | 12/2019 | Sato | F02F 1/14 |

FOREIGN PATENT DOCUMENTS

| | | | |
|---|---|---|---|
| JP | 2014-208977 | A | 11/2014 |
| KR | 10-1601224 | B1 | 3/2016 |
| WO | WO 98/54455 | A1 | 12/1998 |

* cited by examiner

ENGINE COOLING SYSTEM FOR VEHICLE

CROSS-REFERENCE TO RELATED APPLICATION

The present application claims priority to Korean Patent Application No 10-2017-0173874 filed on Dec. 18, 2017, the entire contents of which is incorporated herein for all purposes by this reference.

BACKGROUND OF THE INVENTION

Field of the Invention

The present invention relates to an engine cooling system for a vehicle. More particularly, the present invention relates to an engine cooling system for a vehicle that may improve overall cooling efficiency by controlling a coolant flow.

Description of Related Art

Generally, some of heat generated at a combustion chamber of an engine is absorbed by a cylinder head, a cylinder block, intake and exhaust valves, a piston, etc.

When temperatures of the constituent components of the engine excessively increase, the constituent components may be thermally deformed, or an oil film of an internal wall of a cylinder may be damaged such that lubrication performance deteriorates, resulting in thermal problems of the engine.

Due to the thermal problems of the engine, abnormal combustion such as combustion failure, knocking, etc. occurs, thus a piston may be melted, which may result in serious damage to the engine. Furthermore, thermal efficiency and power of the engine may deteriorate. In contrast, excessive cooling of the engine may cause the power and fuel consumption to deteriorate, and may cause low temperature abrasion of the cylinder, thus it is necessary to appropriately control temperature of the coolant.

In the present respect, in a typical engine, a water jacket is provided inside a cylinder block and a cylinder head, and a coolant circulating in the water jacket cools a periphery of a spark plug corresponding to a combustion chamber and metal surfaces such as peripheries of an exhaust port, a valve seat, etc.

However, in the typical engine, since the coolant flowing in according to the order of cylinders is sequentially circulated in the water jacket provided in the cylinder block and the cylinder head, the cylinder block and the cylinder head corresponding to the combustion chamber are not effectively cooled, such that the engine is not entirely fully cooled.

Furthermore, durability of the engine deteriorates due to the poor cooling efficiency of the engine, and if a separate cooling jet is provided and a high performance water pump is used to prevent the deterioration of the durability of the engine, costs thereof may increase.

Also, the cylinder head cools down to a relatively lower temperature than the cylinder block, but there are drawbacks that are difficult to control a coolant's temperature.

Furthermore, when the temperature of the coolant is low, viscosity of engine oil is high, thus as frictional force increases, fuel consumption increases, that is, fuel efficiency deteriorates, while when the coolant temperature is excessively high, since knocking occurs, performance of the engine may deteriorate by adjusting ignition timing to suppress the knocking.

On the other hand, recently, while separating the coolant flowing through the cylinder block and the cylinder head, studies regarding a water jacket are underway to sequentially flow the coolant flow from the front side (a first combustion chamber side) to the rear side (a fourth combustion chamber side).

At the same time, researches are in progress to effectively control the temperature around the combustion chamber by allowing the coolant to flow in a narrow space between the cylinder bores.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing an engine cooling system for a vehicle for flowing the coolant from the front side to the rear side based on an arrangement direction of the cylinder and simultaneously cooling the coolant by a cross flow type to flow from an exhaust side to an intake side between each combustion chambers while separating and cooling the coolant flowing through the cylinder block and the cylinder head, maximizing an entire cooling efficiency through a flow control of the coolant and reducing a fuel consumption.

An engine cooling system for a vehicle according to an exemplary embodiment of the present invention in which a plurality of combustion chambers are formed from a front side to a rear side and for cooling an engine including a cylinder block to which a cylinder head is mounted upward, may include a head water jacket formed inside the cylinder head; a block water jacket formed around the combustion chamber inside the cylinder block; a gasket disposed between the block water jacket and the head water jacket and sealing between the cylinder block and the cylinder head; a pump water jacket connected to the block water jacket inside the cylinder block by corresponding to a water pump mounted on the front side of the cylinder block to pump a coolant to the front side of the block water jacket; first and second connection passages formed at a front upper portion of the block water jacket, connected to a front lower portion of the head water jacket, and supplying the coolant supplied to the block water jacket to the head water jacket; a first packing member mounted on the intake side in the front side of the block water jacket and preventing the coolant flowing to the front side of the block water jacket from inflowing to the intake side; and a second packing member mounted on the exhaust side in the rear side of the block water jacket and limiting a flow rate of the coolant flowing along the exhaust side of the block water jacket.

The first connection passage may be formed on the exhaust side based on a center of the combustion chamber, and the second connection passage may be formed on the intake side at the position separated from the first connection passage.

The cross-section of the first connection passage may be formed to be greater than the cross-section of the second connection passage.

The block water jacket may further include a third connection passage formed toward the second connection passage based on the first packing member; and a fourth connection passage formed on the intake side at the rear side of the block water jacket based on the first packing member.

The cross-section of the third connection passage may be formed to be greater than the cross-section of the fourth connection passage.

The gasket may include a first penetration hole at the position corresponding to the first connection passage; a second penetration hole at the position corresponding to the second connection passage; a third penetration hole at the position corresponding to the third connection passage; and a fourth penetration hole at the position corresponding to the fourth connection passage.

An expansion portion for receiving the coolant from the water pump and for supplying the coolant to the head water jacket may be integrally formed at the front side of the block water jacket.

A coolant inlet to which the block water jacket and the pump water jacket are connected may be formed at the expansion portion, and the coolant inlet may be disposed toward the intake side based on the combustion chamber.

A coolant control valve including one side connected to the head water jacket and the other side connected to the rear side of the block water jacket to receive the coolant may be disposed at the rear side of the cylinder head.

a plurality of cross connection portions respectively connecting the block water jacket from the exhaust side to the intake side between the combustion chambers may be formed at the block water jacket.

The cross connection portion may be formed inside the cylinder block through a drilling process.

The first packing member may be press-fitted from the top portion to the bottom on one side of the front side of the block water jacket and may block the intake side flow of the coolant inflowing from the front side of the block water jacket so that the coolant flows from the exhaust side to the intake side of the block water jacket through the cross connection portion.

The second packing member may be press-fitted from the top portion to the bottom on one side of the rear side of the block water jacket and may be formed with a length shorter than the first packing member so that only a predetermined flow rate flows from the rear side of the exhaust side to the intake side of the block water jacket.

The second packing member may block a predetermined portion from the top portion to the bottom based on a height direction of the block water jacket at the rear side of the block water jacket to control the flow rate of the coolant.

The first and second packing member may have a circular cylinder shape and may be formed of an elastic material to be press-fitted while being elastic-deformed to the block water jacket.

An outlet exhausting the coolant upward may be formed at the rear upper end portion of the block water jacket.

A fifth penetration hole may be formed corresponding to the outlet at the rear one side at the gasket.

Accordingly, if the engine cooling system for the vehicle according to an exemplary embodiment of the present invention configured as above-described, the portion of the coolant supplied to the front side (the first combustion chamber side) of the block water jacket is supplied to the head water jacket and the rest flows to the rear side (the fourth combustion chamber side), realizing the structure in which the coolant flows from the front side to the rear side also in the head water jacket.

Also, the present invention forms each cross connection portion 39 between the combustion chambers in the block water jacket and cools the coolant passing through the block water jacket with the cross flow type to flow from the exhaust side to the intake side through the first and second packing members and each the cross connection portion 39, maximizing the cooling effect of the engine.

Also, as the present invention applies the first packing member provided at the intake side in the front side of the block water jacket and the second packing member provided at the exhaust side in the rear side of the block water jacket, the flow speed of the coolant may increase at the exhaust side in which the temperature is relatively high, the flow speed of the coolant may decrease at the intake side in which the temperature is relatively low.

Also, the crack and the damage of the cylinder head may be prevented and the durability of the cylinder head may be improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
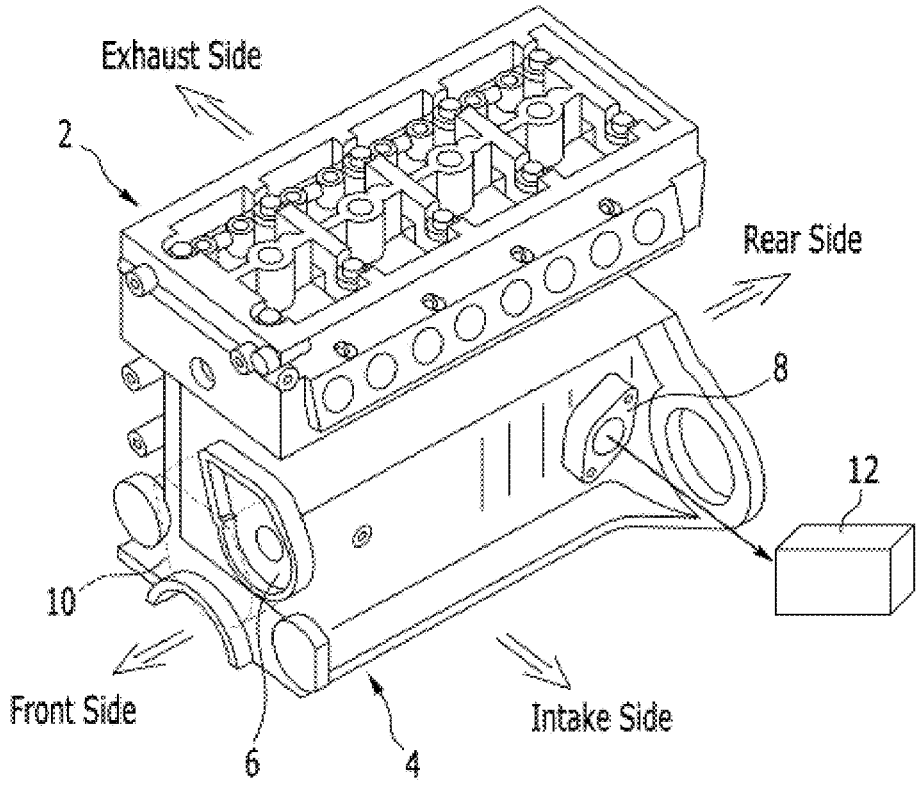
FIG. 1 is a perspective view of an engine to which an engine cooling system for a vehicle according to an exemplary embodiment of the present invention is applied.

It may be understood that the appended drawings are not necessarily to scale, presenting a somewhat simplified representation of various features illustrative of the basic principles of the invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the other hand, the invention(s) is/are intended to cover not only the exemplary embodiments of the present invention, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Before a description, an exemplary embodiment which is described in the present embodiment and a configuration which is shown in the drawings are only an exemplary embodiment of the present invention and do not represent the entire spirit and scope of the invention and thus it may be understood that various modifications and exemplary variations that can replace the exemplary embodiment and the configuration may exist at an application time point of the present invention.

To clearly describe the present invention, parts that are irrelevant to the description are omitted, and identical or similar constituent elements throughout the specification are denoted by the same reference numerals.

Since the size and thickness of each configuration shown in the drawings are arbitrarily shown for convenience of description, the present invention is not necessarily limited to configurations illustrated in the drawings, and to clearly illustrate several parts and areas, enlarged thicknesses are shown.

Moreover, throughout the specification, unless explicitly described to the contrary, the word "comprise" and variations such as "comprises" or "comprising" will be understood to imply the inclusion of stated elements but not the exclusion of any other elements.

Furthermore, terms such as ". unit", ".means", ". part", and ". member" described in the specification mean a unit of a comprehensive configuration having at least one function or operation.

Figure 2:
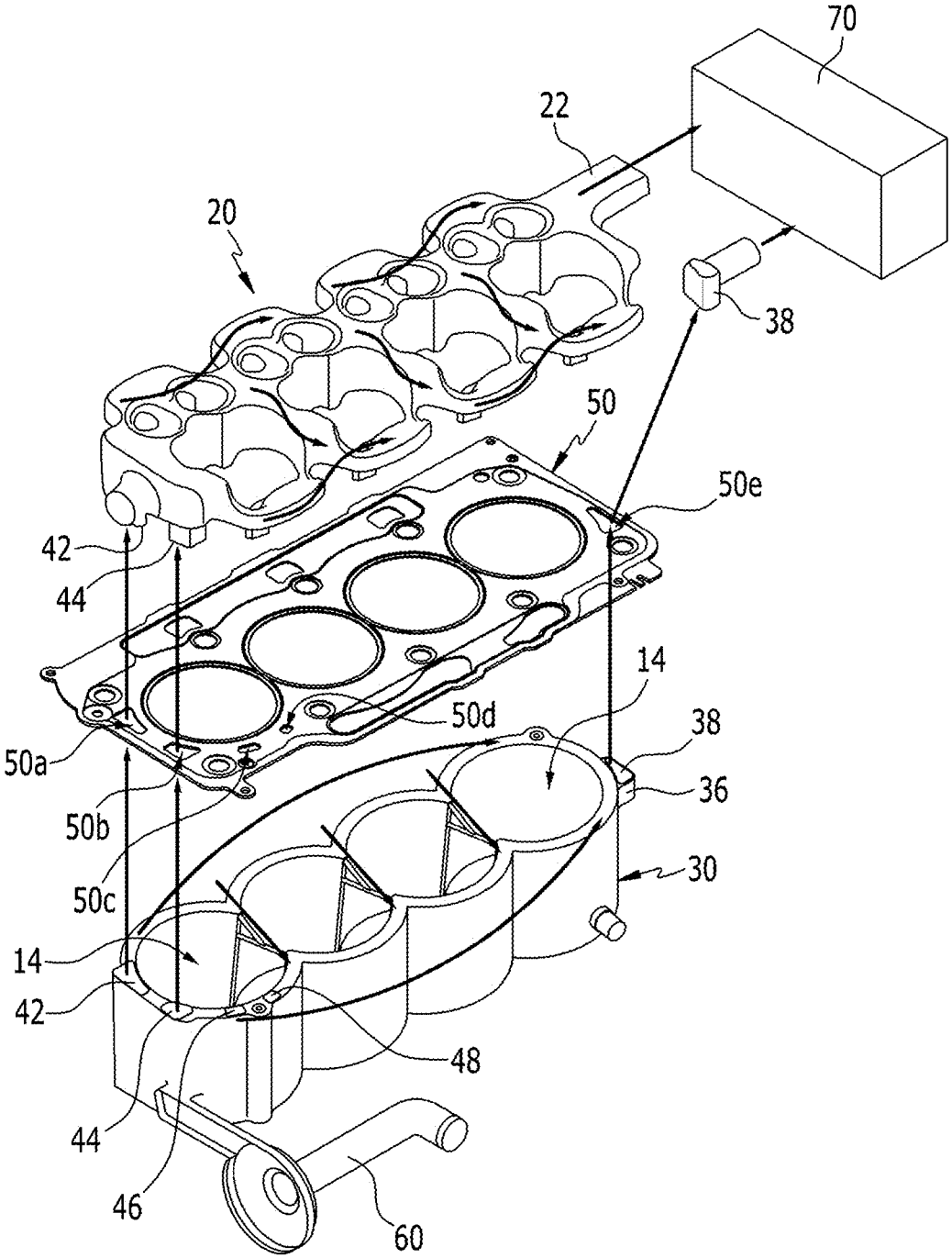
FIG. 2 is an exploded perspective view of a block water jacket and a head water jacket applied to an engine cooling system for a vehicle according to an exemplary embodiment of the present invention.
Figure 3:
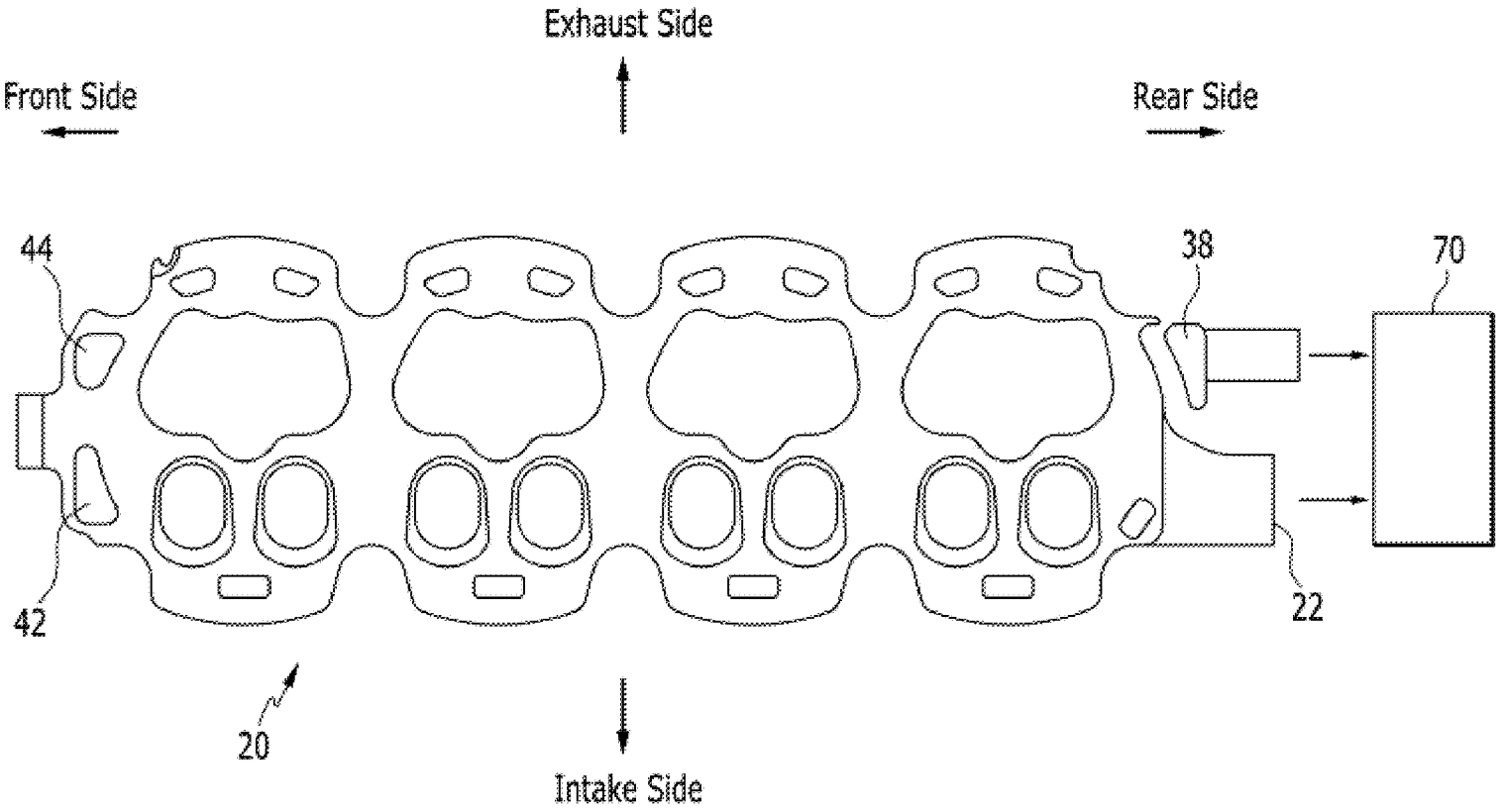
FIG. 3 is a bottom view of a head water jacket in an engine cooling system for a vehicle according to an exemplary embodiment of the present invention.
Figure 4:
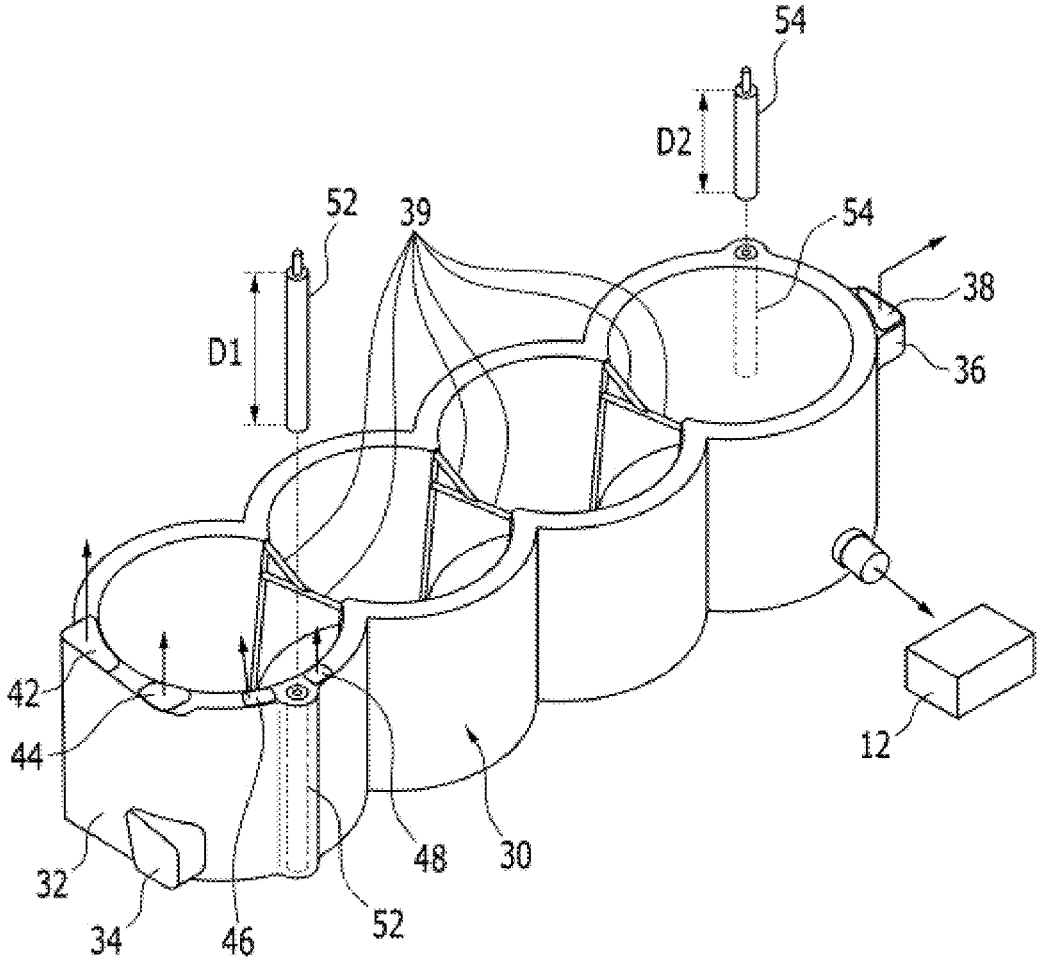
FIG. 4 is a perspective view of a block water jacket in an engine cooling system for a vehicle according to an exemplary embodiment of the present invention.
Figure 5:
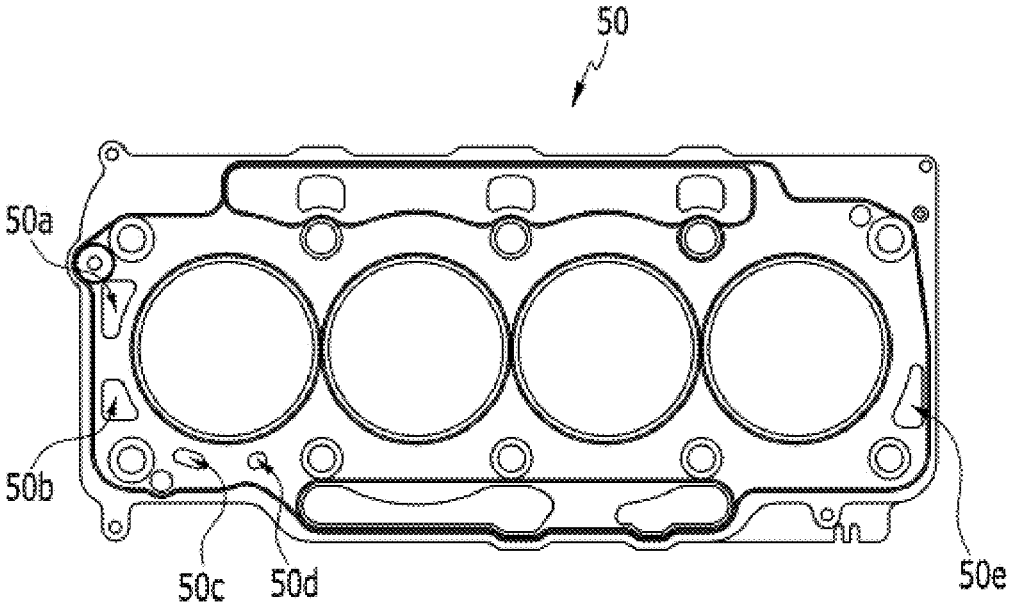
FIG. 5 is a top plan view of a gasket in an engine cooling system for a vehicle according to an exemplary embodiment of the present invention.

FIG. 1 is a perspective view of an engine to which an engine cooling system for a vehicle according to an exemplary embodiment of the present invention is applied, FIG. 2 is an exploded perspective view of a block water jacket and a head water jacket applied to an engine cooling system for a vehicle according to an exemplary embodiment of the present invention, FIG. 3 is a bottom view of a head water jacket in an engine cooling system for a vehicle according to an exemplary embodiment of the present invention, FIG. 4 is a perspective view of a block water jacket in an engine cooling system for a vehicle according to an exemplary embodiment of the present invention, and FIG. 5 is a top plan view of a gasket in an engine cooling system for a vehicle according to an exemplary embodiment of the present invention.

Referring to FIG. 1, an engine to which an engine cooling system according to an exemplary embodiment of the present invention is applied includes a cylinder head 2 and a cylinder block 4, and the cylinder head 2 is mounted on the cylinder block 4.

A mounting portion 6 to which a water pump 10 is mounted is formed at the front side of the cylinder block 4, a block temperature sensor 12 is connected to the intake side of the cylinder block 3, and a connection port 8 supplying the coolant to the block temperature sensor 12 is formed.

As shown in FIG. 2, inside the cylinder head 2, a head water jacket 20 is formed to enclose a plurality of intake ports and exhaust ports that are non-illustrated.

Also, in the cylinder block 4, four combustion chambers 14 are spaced from the front side to the rear side at a predetermined interval. Inside the cylinder block 4, a block water jacket 30 is formed to enclose a circumference of the combustion chambers 14. The block water jacket 30 is disposed under the head water jacket 20.

Here, a gasket 50 is disposed between the head water jacket 20 and the block water jacket 30. The gasket 50 may seal between the cylinder head 2 and the cylinder block 4.

Here, at the front side of the block water jacket 30, a pump water jacket 60 connected to the block water jacket 30 is formed to pump the coolant to the block water jacket 30.

The pump water jacket 60 may be provided corresponding to the water pump 10 inside the cylinder block 4.

That is, the coolant pumped through the operation of the water pump 10 may be smoothly supplied to the front side of the block water jacket 20 through the pump water jacket 60.

Here, at the rear side of the cylinder head 2, a coolant control valve 70 having one side connected to the head water jacket 20 and the other side connected to the rear side end portion of the block water jacket 30 to receive the coolant.

Accordingly, a portion among the coolant supplied to the front side of the block water jacket 30 moves upward to be supplied to a front lower portion of the head water jacket 20. The rest coolant except for the coolant supplied to the head water jacket 20 cools the cylinder block 4 while moving from the block water jacket 30 to the rear side and then is ejected to one side of the coolant control valve 70.

The coolant supplied to the head water jacket 20 cools the cylinder head 2 while moving from the front side to the rear side and is ejected to the other side of the coolant control valve 70.

Also, the front side of the block water jacket 30 receives the coolant from the water pump 10 and an expansion portion 32 may be integrally formed to supply the coolant to the head water jacket 20.

At the expansion portion 32, a coolant inlet 34 to which the block water jacket 30 and the pump water jacket 60 are connected is formed. The coolant inlet 34 may be disposed toward the intake side based on the combustion chamber 14.

Also, in the rear side of the block water jacket 30, a protruded portion 36 may be formed at the intake side, and an outlet 38 exhausting the coolant to the coolant control valve 70 may be formed on the protruded portion 36.

Referring to FIG. 3 and FIG. 4, the head water jacket 20 and the block water jacket 30 are connected through first and second connection passages 42 and 44.

Here, the first and second connection passages 42 and 44 may connect the block water jacket 30 to the head water jacket 20 on the expansion portion 32.

The first and second connection passages 42 and 44 may connect the front lower portion of the head water jacket 20 and the front upper portion of the block water jacket 30 and may supply the coolant supplied to the block water jacket 30 to the head water jacket 20.

Here, the first connection passage 42 is formed at the exhaust side with reference to the center of the combustion chamber 14. Also, the second connection passage 44 may be formed at the intake side at the position separated from the first connection passage 42.

The cross-section of the first connection passage 42 may be formed to be greater than the cross-section of the second connection passage 44. That is, the flow rate of the coolant passing through the first connection passage 42 is greater than the flow rate of the coolant passing through the second connection passage 44.

Accordingly, as the coolant of the greater flow rate inflows to the exhaust side through the first connection passage 42 in the cylinder head 2, the cooling efficiency of the exhaust side may be improved in the cylinder head 2.

Also, as the head outlet 22 connected to the coolant control valve 70 is formed at the exhaust side in the head water jacket 20, the exhaust side cooling efficiency of the cylinder head 2 may be entirely improved.

On the other hand, in the exemplary embodiment of the present invention, in the block water jacket 30, a plurality of cross connection portions 39 connecting the block water jacket 30 from the exhaust side to the intake side is formed between the combustion chambers 14.

The cross connection portions 39 may be formed through a drilling process inside the cylinder block 4. Each cross connection portion 39 is formed at the upper side between the combustion chambers 14.

Each cross connection portion 39 may inflow the coolant passing through the exhaust side of the block water jacket 20 to the intake side between the combustion chambers 14. Accordingly, the coolant passing through the cross connection portion 39 may cool the combustion chambers 14 therebetween.

On the other hand, in the exemplary embodiment of the present invention, first and second packing members 52 and 54 may be mounted on the block water jacket 30.

The first and second packing members 52 and 54 may move the coolant through the cross connection portion 39 by controlling a flow direction of the coolant flowing through the internal to the block water jacket 30.

First, the first packing member 52 is mounted on the intake side at the front side of the block water jacket 30 and may prevent the coolant inflowing to the front side of the block water jacket 30 to the intake side thereof.

Here, the first packing member 52 is press-fitted from the top portion to the bottom on one side of the front side of the block water jacket 30. The first packing member 52 may completely block the intake side flow of the coolant inflowing at the front side of the block water jacket 30 to as to flow the coolant from the exhaust side to the intake side of the block water jacket 30 through the cross connection portion 39.

Also, the second packing member 54 may be mounted on the exhaust side at the rear side of the block water jacket 30 and may limit the flow rate of the coolant flowing along the exhaust side of the block water jacket 30.

Here, the second packing member 54 is press-fitted from the top portion to the bottom at one side of the rear side of the block water jacket 30. The second packing member 54 may be formed with a length shorter than the first packing member 52 to flow only a predetermined flow rate from the rear side of the exhaust side of the block water jacket 30 to the intake side.

That is, a length D1 of the first packing member 52 is formed with the length longer than the length D2 of the second packing member 54 (D1>D2).

That is, the second packing member 54 may prevent a predetermined portion from the top portion to the bottom based on a height direction of the block water jacket 30 at the rear side of the block water jacket 30, controlling the flow rate of the coolant.

Accordingly, as the second packing member 54 limits the flow of the coolant from the rear side of the exhaust side of the block water jacket 30 to the intake side, the flow rate of the coolant flowing to the intake side through the cross connection portion 39 may increase.

On the other hand, in the exemplary embodiment of the present invention, the first packing member 52 disposed at the front side of the block water jacket 30 may be disposed to be biased to the intake side, and the second packing member 54 disposed at the rear side may be disposed to be biased to the exhaust side.

The first and second packing members 52 and 54 configured as above-described have a circular cylinder shape and may be formed of an elastic material, for example, a rubber material to be press-fitted while being elastically deformed for the block water jacket 30.

On the other hand, in the exemplary embodiment of the present invention, the block water jacket 30 may further include third and fourth connection passages 46 and 48.

First, the third connection passage 46 is formed toward the second connection passage 44 based on the first packing member 52.

Also, the fourth connection passage 48 is formed on the intake side at the rear side of the block water jacket 30 based on the first packing member 52.

Here, the cross-section of the third connection passage 46 may be formed to be greater than the cross-section of the fourth connection passage 48.

Accordingly, the flow rate of the coolant inflowing to the intake side of the head water jacket 20 through the third connection passage 46 may be greater than the flow rate of the coolant inflowing to the intake side of the cylinder head 20 through the fourth connection passage 48.

For example, the flow rate of the coolant inflowing to the intake side of the cylinder head 20 through the fourth connection passage 48 may be half of the flow rate of the coolant inflowing to the intake side of the head water jacket 20 through the third connection passage 46.

On the other hand, the gasket 50, as shown in FIG. 5, may include first, second, third, fourth, and fifth penetration holes 50*a*, 50*b*, 50*c*, 50*d*, and 50*e*.

First, the first penetration hole 50*a* is formed at the position corresponding to the first connection passage 42, and the second penetration hole 50*b* is formed at the position corresponding to the second connection passage 44.

The third penetration hole 50*c* is formed at the position corresponding to the third connection passage 46, and the fourth penetration hole 50*d* is formed at the position corresponding to the fourth connection passage 48.

Finally, the fifth penetration hole 50*e* is formed corresponding to the outlet 38 at the rear one side.

These first, second, third and fourth penetration holes 50*a*, 50*b*, 50*c*, and 50*d* make the coolant smoothly flow from the block water jacket 30 to the head water jacket 20 through the first, second, third and fourth connection passages 42, 44, 46, and 48. Also, the fifth penetration hole 50*e* may smoothly exhaust the coolant from the block water jacket 30 to the coolant control valve 70 through the outlet 38.

Figure 6:
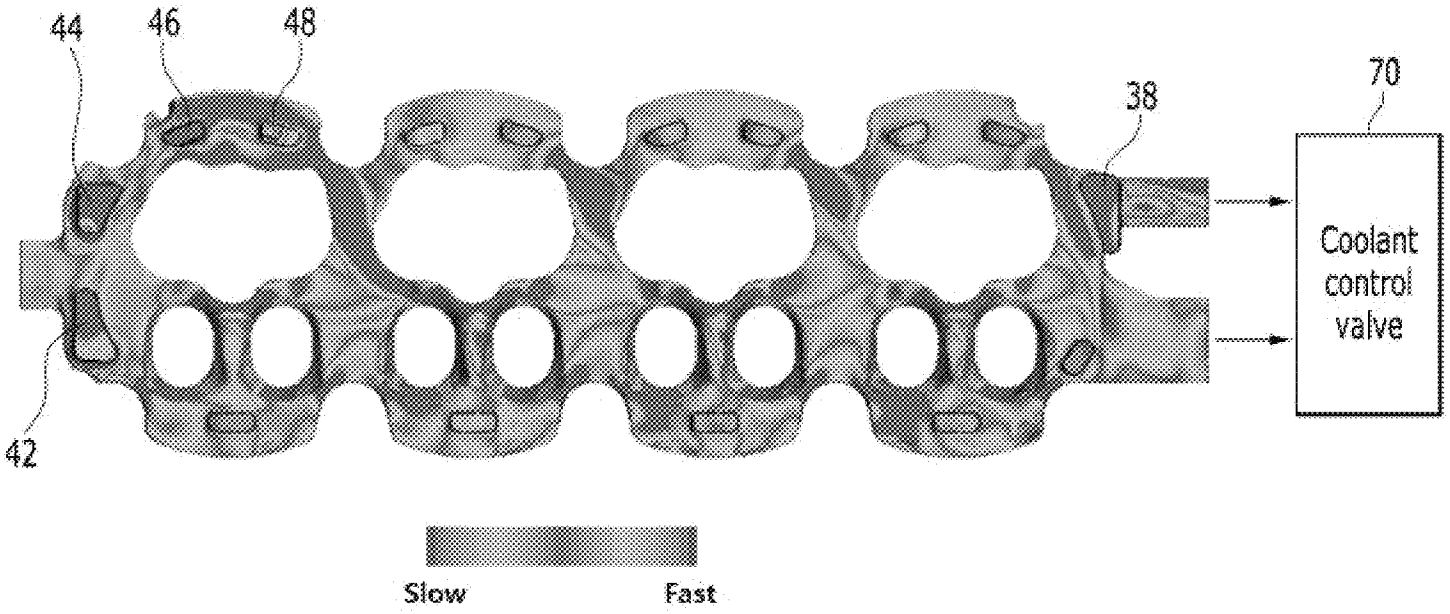
FIG. 6 is a view showing a coolant flow of a head water jacket in an engine cooling system for a vehicle according to an exemplary embodiment of the present invention.

FIG. 6 is a view showing a coolant flow of a head water jacket in an engine cooling system for a vehicle according to an exemplary embodiment of the present invention.

Referring to FIG. 6, the flow of the exhaust side coolant is a fast coolant flow and the flow of the intake side coolant is a slow coolant flow.

It may be confirmed that the flow speed of the coolant supplied to the head water jacket 20 is fastest in the first, second, and third connection passages 42, 44, and 46.

Here, it may be confirmed that the flow speed of the coolant supplied to the head water jacket 20 through the fourth connection passage 48 may be relatively lower than the first, second, and third connection passages 42, 44, and 46.

This is the reason that the cross-section of the fourth connection passage 48 is small and the coolant supplied to the front side of the block water jacket 30 may be completely blocked to the intake side by the first packing member 52.

Also, a structure that the coolant flowing into the head water jacket 20 flows from the front side to the rear side is shown, and it may be confirmed that the flow speed of the coolant is fast at the exhaust side compared with the intake side.

Also, it may be confirmed that the coolant is fast ejected to the coolant control valve 70 through the head outlet 22 and the outlet 38.

That is, in the exemplary embodiment of the present invention, as the coolant inflowing to the head water jacket 20 through the first, second, third and fourth connection passages 42, 44, 46, and 48 fast flows at the exhaust side compared with the intake side, the exhaust side that has the relatively high temperature may be efficiently cooled in the cylinder head 2.

Figure 7:
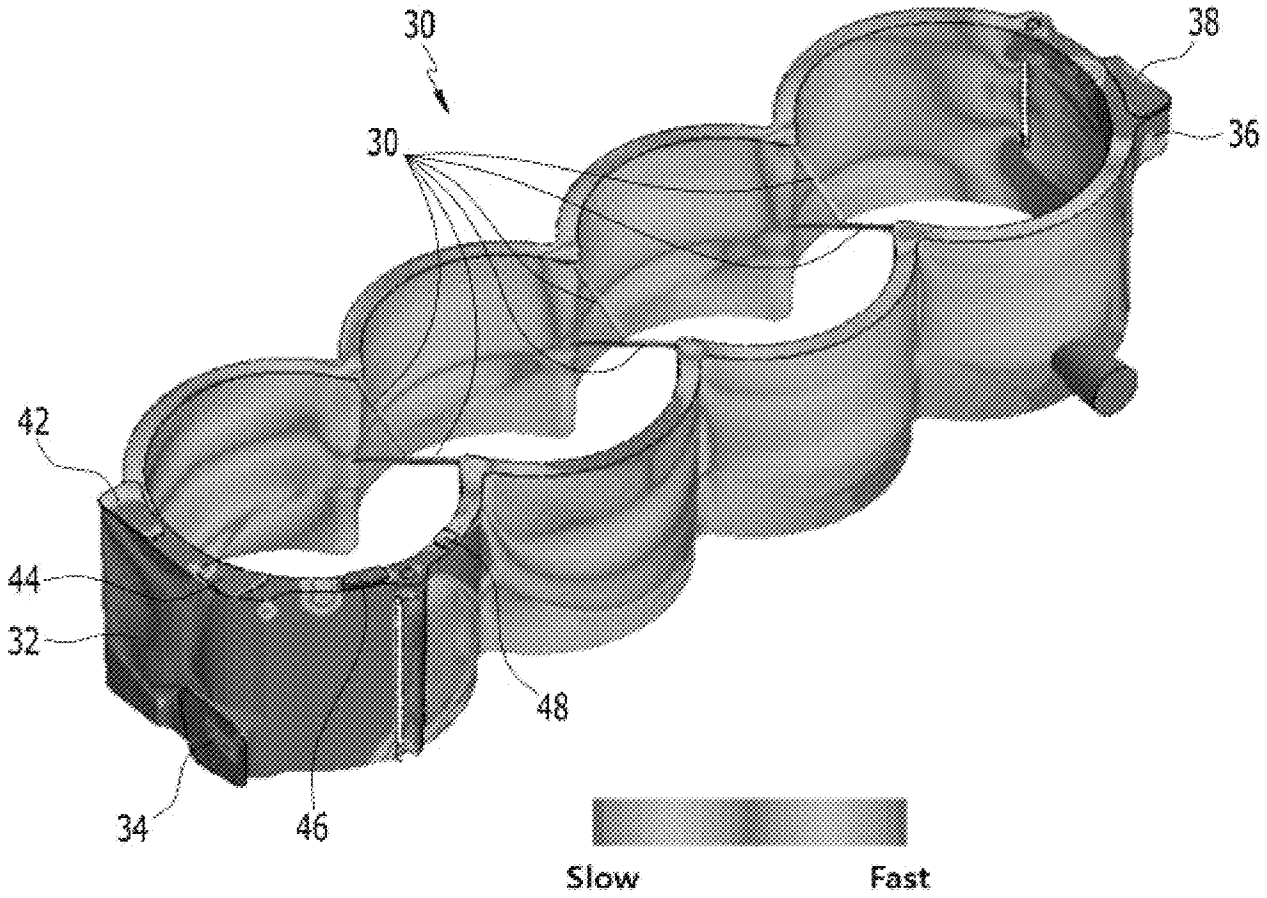
FIG. 7 is a view showing a coolant flow of a block water jacket in an engine cooling system for a vehicle according to an exemplary embodiment of the present invention.

FIG. 7 is a view showing a coolant flow of a block water jacket in an engine cooling system for a vehicle according to an exemplary embodiment of the present invention.

Referring to FIG. 7, the flow of the exhaust side coolant is the fast coolant flow, and the flow of the intake side coolant is the slow coolant flow.

It may be confirmed that the flow speed of the coolant supplied to the block water jacket 30 is fastest in the coolant inlet 34 provided in the expansion portion 32, and the first, second, and third connection passages 42, 44, and 46.

Here, it may be confirmed that the flow speed of the coolant supplied to the block water jacket 30 through the fourth connection passage 48 is relatively low compared with the first, second, and third connection passages 42, 44, and 46.

This is the reason that the first packing member 52 prevents the coolant inflowing to the front side of the block water jacket 20 from flowing to the intake side. Accordingly, the flow speed of the coolant passing through the exhaust side of the block water jacket 30 may be fast compared with the intake side.

That is, the first packing member 52 may prevent the coolant from flowing to the intake side from the front side of the block water jacket 30, and the second packing member 54 may limit the coolant to flow with a predetermined flow rate from the exhaust side to the intake side at the rear side of the block water jacket 30.

Also, it may be confirmed that the coolant passing through the block water jacket 30 is also rapidly ejected through the outlet 38 while realizing the cross flow type in which the coolant flows from the front side to the rear side simultaneously flows from the exhaust side to the intake side through the cross connection portion 39.

Accordingly, the coolant flowing into the block water jacket 30 increases the flow rate and the flow speed at the exhaust side and cools between the combustion chambers 14 through each cross connection portion 39, effectively cooling the cylinder block 4.

Accordingly, if the engine cooling system for the vehicle according to an exemplary embodiment of the present invention configured as above-described, the portion of the coolant supplied to the front side (the first combustion chamber side) of the block water jacket 30 is supplied to the head water jacket 20 and the rest flows to the rear side (the fourth combustion chamber side), realizing the structure in which the coolant flows from the front side to the rear side also in the head water jacket 20.

Also, the present invention forms each cross connection portion 39 between the combustion chambers 14 in the block water jacket 30 and cools the coolant passing through the block water jacket 30 with the cross flow type to flow from the exhaust side to the intake side through the first and second packing members 52 and 54 and each the cross connection portion 39, maximizing the cooling effect of the engine.

Also, as the present invention applies the first packing member 52 provided at the intake side in the front side of the block water jacket 30 and the second packing member 54 provided at the exhaust side in the rear side of the block water jacket 30, the flow speed of the coolant may increase at the exhaust side in which the temperature is relatively high, the flow speed of the coolant may decrease at the intake side in which the temperature is relatively low.

Also, the crack and the damage of the cylinder head may be prevented and the durability of the cylinder head may be improved.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine cooling system for a vehicle in which a plurality of combustion chambers is formed from a front side to a rear side of an engine and for cooling the engine including a cylinder block to which a cylinder head is mounted upwards thereof, the engine cooling system comprising:

a head water jacket formed inside the cylinder head;

a block water jacket formed around the combustion chambers inside the cylinder block;

a gasket disposed between the block water jacket and the head water jacket and sealing between the cylinder block and the cylinder head;

a pump water jacket connected to the block water jacket inside the cylinder block by corresponding to a water pump mounted on a front side of the cylinder block to pump a coolant to a front side of the block water jacket;

first and second connection passages formed at a front upper portion of the block water jacket, connected to a front lower portion of the head water jacket, and supplying the coolant supplied to the block water jacket to the head water jacket;

a first packing member mounted on an intake side in the front side of the block water jacket and preventing the coolant flowing to the front side of the block water jacket from inflowing to the intake side; and a second packing member mounted on an exhaust side in a rear side of the block water jacket and limiting a flow rate of the coolant flowing along the exhaust side of the block water jacket, wherein the block water jacket further includes:

a third connection passage formed toward the second connection passage based on the first packing member; and a fourth connection passage formed on the intake side at the rear side of the block water jacket based on the first packing member, and wherein a cross-section of the third connection passage is formed to be greater than a cross-section of the fourth connection passage.

2. The engine cooling system for the vehicle of claim 1, wherein the first connection passage is formed on the exhaust side based on a center of the combustion chambers, and the second connection passage is formed on the intake side at a position separated from the first connection passage.

3. The engine cooling system for the vehicle of claim 1, wherein a cross-section of the first connection passage is formed to be greater than a cross-section of the second connection passage.

4. The engine cooling system for the vehicle of claim wherein the gasket includes:

a first penetration hole at a position corresponding to the first connection passage;

a second penetration hole at a position corresponding to the second connection passage;

a third penetration hole at a position corresponding to the third connection passage; and a fourth penetration hole at a position corresponding to the fourth connection passage.

5. The engine cooling system for the vehicle of claim 4, wherein a fifth penetration hole is formed corresponding to the outlet at a rear side at the gasket.

6. The engine cooling system for the vehicle of claim 1, wherein an expansion portion for receiving the coolant from the water pump and for supplying the coolant to the head water jacket is integrally formed at the front side of the block water jacket.

7. The engine cooling system for the vehicle of claim 6, wherein a coolant inlet to which the block water jacket and the pump water jacket are connected is formed at the expansion portion, and the coolant inlet is disposed toward the intake side based on the combustion chambers.

8. The engine cooling system for the vehicle of claim 1, wherein a coolant control valve including a first side connected to the head water jacket and a second side connected to the rear side of the block water jacket to receive the coolant is disposed at the rear side of the cylinder head.

9. The engine cooling system for the vehicle of claim 1, wherein a plurality of cross connection portions respectively connecting the block water jacket from the exhaust side to the intake side between the combustion chambers is formed at the block water jacket.

10. The engine cooling system for the vehicle of claim 9, wherein the cross connection portions are formed inside the cylinder block through a drilling process.

11. The engine cooling system for the vehicle of claim 9, wherein the first packing member is press-fitted from a top portion to a bottom portion on a side of the front side of the block water jacket and blocks an intake side flow of the coolant inflowing from the front side of the block water jacket so that the coolant flows from the exhaust side to the intake side of the block water jacket through the cross connection portions.

12. The engine cooling system for the vehicle of claim 1, wherein the second packing member is press-fitted from a top portion to a bottom on a side of the rear side of the block water jacket and is formed with a length shorter than the first packing member so that only a predetermined flow rate flows from a rear side of the exhaust side to the intake side of the block water jacket.

13. The engine cooling system for the vehicle of claim 12, wherein the second packing member blocks a predetermined portion from a top portion to a bottom portion based on a height direction of the block water jacket at the rear side of the block water jacket to control the flow rate of the coolant.

14. The engine cooling system for the vehicle of claim 1, wherein the first and second packing member has a circular cylinder shape and is formed of an elastic material to be press-fitted while being elastic-deformed at the block water jacket.

15. The engine cooling system for the vehicle of claim 1, wherein an outlet exhausting the coolant upward is formed at a rear upper end portion of the block water jacket.

16. The engine cooling system for the vehicle of claim 15, wherein a protruded portion is formed at the intake side of the block water jacket and the outlet is formed on the protruded portion.

17. The engine cooling system for the vehicle of claim 16, wherein a coolant control valve including a first side connected to the head water jacket and a second side connected to the outlet of the block water jacket to receive the coolant is disposed at the rear side of the cylinder head.

* * * * *